US010856581B2

(12) United States Patent
Qiu

(10) Patent No.: US 10,856,581 B2
(45) Date of Patent: Dec. 8, 2020

(54) CIGARETTE CARTRIDGE AND ELECTRONIC CIGARETTE USING THE SAME

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 209 days.

(21) Appl. No.: 16/075,062

(22) PCT Filed: Dec. 30, 2016

(86) PCT No.: PCT/CN2016/113446
§ 371 (c)(1),
(2) Date: Aug. 2, 2018

(87) PCT Pub. No.: WO2017/143865
PCT Pub. Date: Aug. 31, 2017

(65) Prior Publication Data

US 2019/0037926 A1 Feb. 7, 2019

(30) Foreign Application Priority Data

Feb. 27, 2016 (CN) ..... 2016 1 0109408

(51) Int. Cl.
*A24F 47/00* (2020.01)
*A24F 40/40* (2020.01)
*A24F 40/10* (2020.01)

(52) U.S. Cl.
CPC ..... *A24F 47/008* (2013.01); *A24F 40/10* (2020.01); *A24F 40/40* (2020.01)

(58) Field of Classification Search
CPC ..... A24F 47/008; A24F 40/10; A24F 40/40
See application file for complete search history.

(56) References Cited

U.S. PATENT DOCUMENTS 4,171,000 A 10/1979 Uhle
9,872,520 B1 * 1/2018 Elson ..... A24F 47/008
(Continued)

FOREIGN PATENT DOCUMENTS

CN 201718468 U 1/2011
CN 202456410 U 10/2012
(Continued)

OTHER PUBLICATIONS

English machine translation CN204217907 (Year: 2020).*

*Primary Examiner* — Eric Yaary
*Assistant Examiner* — Jennifer A Kessie
(74) *Attorney, Agent, or Firm* — Novick, Kim & Lee, PLLC; Allen Xue

(57) ABSTRACT

A cigarette cartridge (21) has a liquid-storage assembly and a vaporization assembly. The vaporization assembly is disposed in the liquid-storage assembly. The liquid-storage assembly has an upper cover (19) having a smog outlet (19-2), and a housing (18). The vaporization assembly has a heat-generating mechanism (111) a atomizing base (9), and a ventilation pipe (14). The heat-generating mechanism (111) is disposed on the atomizing base (9); the atomizing base (9) is sealingly arranged on one end of the housing (18), and the upper cover (19) is arranged on the other end of the housing (18) opposite to the atomizing base (9); the ventilation pipe (14) is in communication with the heat-generating mechanism (111) and the smog outlet (19-2). The space between the ventilation pipe (14), the housing (18), the atomizing base (9), and the upper cover (19) is a liquid-storage chamber (18-5).

10 Claims, 8 Drawing Sheets

(56) References Cited

U.S. PATENT DOCUMENTS

| | | | | |
|---|---|---|---|---|
| 2008/0257367 | A1 | 10/2008 | Paterno et al. | |
| 2014/0283858 | A1 | 9/2014 | Liu | |
| 2018/0084832 | A1* | 3/2018 | Li | A61M 15/06 |

FOREIGN PATENT DOCUMENTS

| | | | |
|---|---|---|---|
| CN | 202603607 | U | 12/2012 |
| CN | 103271448 | A | 9/2013 |
| CN | 203168034 | U | 9/2013 |
| CN | 203168036 | U | 9/2013 |
| CN | 203353683 | U | 12/2013 |
| CN | 103519350 | A | 1/2014 |
| CN | 203457805 | U | 3/2014 |
| CN | 203492792 | U | 3/2014 |
| CN | 203523810 | U | 4/2014 |
| CN | 203633501 | U | 6/2014 |
| CN | 103960781 | A | 8/2014 |
| CN | 203859560 | U | 10/2014 |
| CN | 203897284 | U | 10/2014 |
| CN | 203913376 | U | 11/2014 |
| CN | 203952432 | U | 11/2014 |
| CN | 104305526 | A | 1/2015 |
| CN | 204120231 | U | 1/2015 |
| CN | 104366695 | A | 2/2015 |
| CN | 104368484 | A | 2/2015 |
| CN | 204169060 | U | 2/2015 |
| CN | 204217907 | U | 3/2015 |
| CN | 204259818 | U | 4/2015 |
| CN | 2042599818 | U | 4/2015 |
| CN | 204306042 | U | 5/2015 |
| CN | 204393351 | U | 6/2015 |
| CN | 204540826 | U | 8/2015 |
| CN | 204635086 | U | 9/2015 |
| CN | 204861163 | U | 12/2015 |
| CN | 204861164 | U | 12/2015 |
| CN | 204888728 | U | 12/2015 |
| CN | 105768225 | A | 7/2016 |
| CN | 205390306 | U | 7/2016 |
| WO | 2015/180167 | A1 | 12/2015 |
| WO | 2015180167 | A1 | 12/2015 |

* cited by examiner

CIGARETTE CARTRIDGE AND ELECTRONIC CIGARETTE USING THE SAME

FIELD OF THE INVENTION

The invention relates to a technical field of electronic cigarette, and more particularly, relates to a cigarette cartridge and an electronic cigarette using the same.

BACKGROUND OF THE INVENTION

At present, electronic cigarette is a mature alternative product in the market for smoking. Distinguished from the size, the electronic cigarettes can be grouped into two kinds, one kind is the small cigarette, another kind is the big cigarette. The small cigarette generally indicates the disposable cigarette or the rechargeable small cigarette. The literal meaning of the disposable cigarette indicates that the cigarette can be used only one time. Different manufactures divide the small cigarettes according to the number of puffs, there are cigarettes having 300 puffs, 500 puffs, 800 puffs and so on.

At present, most of the cigarette cartridges of the disposable cigarettes cannot be replaced. The quality of the cartridges varies so that for some disposable cigarette, even if the assembly is accomplished, the user still cannot smoke due to the problems of the cigarette cartridge. However, due to a limitation of the fitting manner, the cigarette cartridge cannot be replaced, leading to a low user experience. In another aspect, the cigarette cartridge of the disposable cigarette of the prior art has a complicated assembly, particularly, the steps of the liquid injection is tedious, a production efficiency is low.

SUMMARY OF THE INVENTION

In view of above, it is necessary to provide an improved cigarette cartridge and an electronic cigarette using the cigarette cartridge, which is very suitable for a requirement of the market.

The technical solution of the invention is that, a cigarette cartridge includes a liquid-storage assembly and an atomizing assembly. The atomizing assembly is positioned within the liquid-storage assembly. The liquid-storage assembly including an upper cover and a housing, the upper cover defines a smog outlet. The atomizing assembly includes a heat generating mechanism, an atomizing base and a ventilation pipe. The heat generating mechanism is positioned on the atomizing base, the atomizing base is hermitically positioned on an end of the housing, the upper cover is positioned on an end of the housing opposite to the atomizing base, the ventilation pipe fluidly communicates with the heat generating mechanism and the smog outlet, the ventilation pipe, the housing, the atomizing base, and the upper cover cooperatively forms a liquid-storage chamber.

Further, the atomizing assembly further includes an atomizing upper cover, the heat generating mechanism is fixed between the atomizing upper cover and the atomizing base, the atomizing upper cover defines a through hole, an end of the ventilation pipe extends through the ventilation hole and fluidly communicates with the heat generating mechanism.

Further, a sealing cover is positioned between the upper cover and the housing, an opposite end of the ventilation pipe extends through the sealing cover and fluidly communicates with the smog outlet.

Further, an inner wall of the housing is provided with a latching portion, the ventilation pipe is positioned by the latching portion.

Further, the heat generating mechanism includes an absorbing member and a heater matching the absorbing member, the atomizing assembly further includes a pair of electrode contact sheets, an anode of the heater and a cathode of the heater are connected to the pair of electrode contact sheets, respectively, and the electrode contact sheet is fixed on the atomizing base Further, an end of the electrode contact sheet defines an electrode latching groove, the anode and the cathode of the heater are latched into the corresponding electrode latching groove, the atomizing base defines a through groove, an opposite end of the electrode contact sheet extends through the through hole, and is bended to allow the electrode contact sheet to be fixed to the atomizing base.

Further, the housing is provided with a latching groove/a latching tab on a periphery of the lower end of the housing, the atomizing base is provided with a latching tab/latching groove on a corresponding periphery of atomizing base, the latching tab latches with the latching groove to stably secure the atomizing base to the lower end of the housing.

The invention further provides an electronic cigarette including any one of aforementioned cigarette cartridge and a battery assembly connected to the cigarette cartridge, the housing of the cigarette cartridge is provided with a joining portion, the joining portion is configured to connect the cigarette cartridge with the battery assembly.

Further, the battery assembly includes a battery housing, a battery bracket, and a battery base, the battery bracket clamps the battery base and is positioned within the battery housing, an inner sidewall of the battery housing is provided with a connecting portion, the joining portion engages the connecting portion to allow the cigarette cartridge to be fixedly connected to the battery assembly.

Further, the battery bracket is provided with a battery anode/cathode contact member, the battery anode/cathode contact member is configured to be connected to an anode and an cathode of the heat generating mechanism, correspondingly, a sealing ring is provided between an upper end of the battery bracket and the battery housing.

Compared to the prior art, in the cigarette cartridge of the invention, the atomizing assembly and the liquid-storage assembly are separately assembled, the assembly between the two are simplified, thereby simplifying the assembly steps, and a fabricating efficiency is improved.

The preferred technical solution and its advantages of the invention will specifically described with reference to the specific embodiment.

BRIEF DESCRIPTION OF THE DRAWINGS

Accompanying drawing is provided for further interpreting the invention, which is incorporated in and constitutes a part of the specification. The accompanying drawing illustrates the invention together with the description, but not constitutes a limitation to the invention, the accompanying drawings in which.

| | | | |
|---|---|---|---|
| battery cover: 1 | battery bracket fixing groove: 5-4 | absorbing member: 11 | joining portion: 18-2 |
| battery cover latching tab: 1-1 | battery bracket sealing ring assembly groove: 5-5 | heater: 12 | upper cover limiting clip: 18-3 |
| control panel: 2 | battery anode/cathode contact member: 6 | atomizing upper cover: 13 | latching portion: 18-4 |
| atomizing upper cover: 3 | probe: 7 | through hole: 13-1 | liquid-storage chamber: 18-5 |
| baro-sensor bracket: 4 | sealing ring: 8 | ventilation pipe: 14 | upper cover: 19 |
| baro-sensor assembly hole: 4-1 | sealing ring latching groove: 8-1 | sealing cover: 15 | upper cover limiting groove: 19-1 |
| wire assembly hole: 4-2 | atomizing base: 9 | battery base: 16 | smog outlet: 19-2 |
| assembly groove: 4-3 | latching tab/latching groove: 9-1 | battery housing: 17 | battery assembly: 20 |
| battery bracket: 5 | atomizing base ventilation hole: 9-2 | connecting portion: 17-1 | cigarette cartridge: 21 |
| baro-sensor bracket assembly groove: 5-1 | through groove: 9-3 | battery bracket limiting protrusion: 17-2 | heat generating mechanism: 111 |
| battery bracket latching groove: 5-2 | electrode contact sheet: 10 | housing: 18 | electronic cigarette: 100 |
| battery bracket ventilation hole: 5-3 | electrode latching groove: 10-1 | latching groove/latching tab: 18-1 | |

DETAILED DESCRIPTION OF THE PREFERRED EMBODIMENT

The embodiment of the invention is specifically described with reference to accompanying drawings. It should be noted that the specific embodiment described hereby is merely for explaining and interpreting the invention, but not limits the invention.

Figure 8:
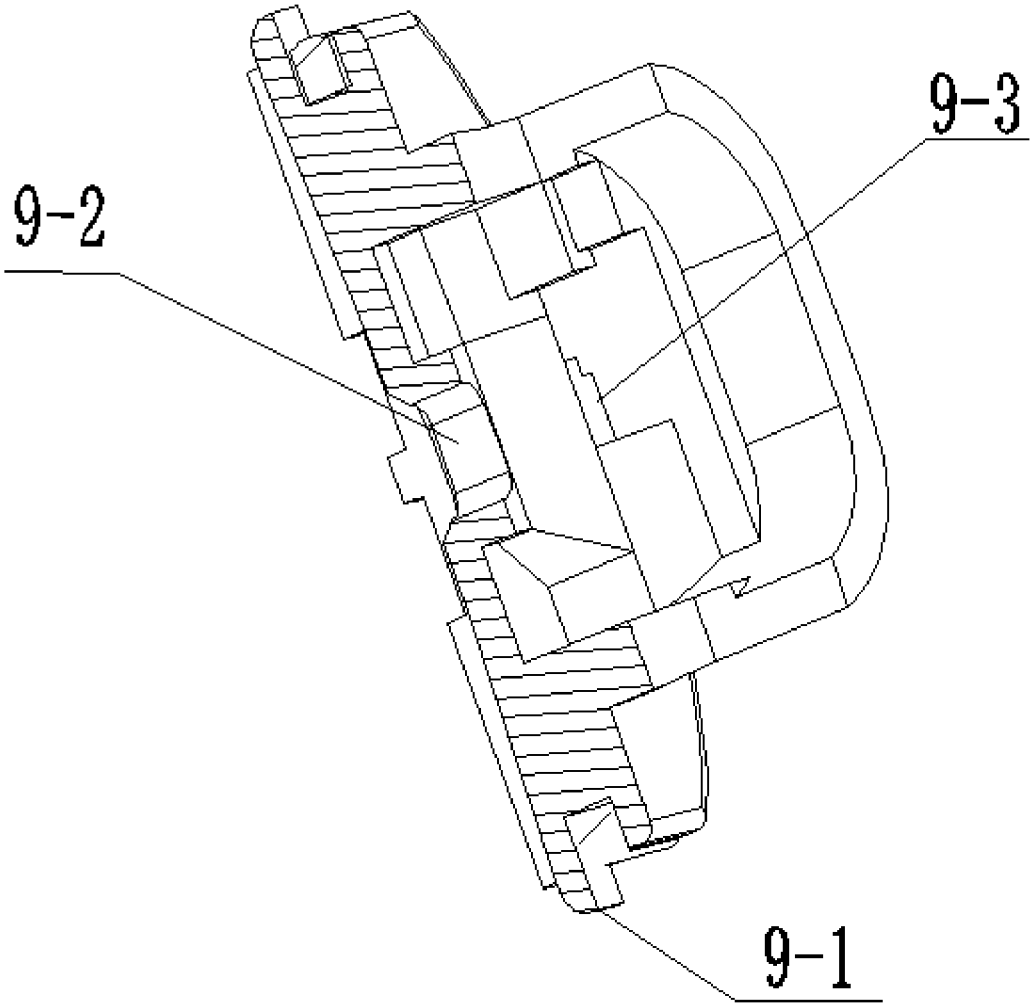
FIG. 8 is a cross-sectional view of an atomizing base of the invention.
Figure 10:
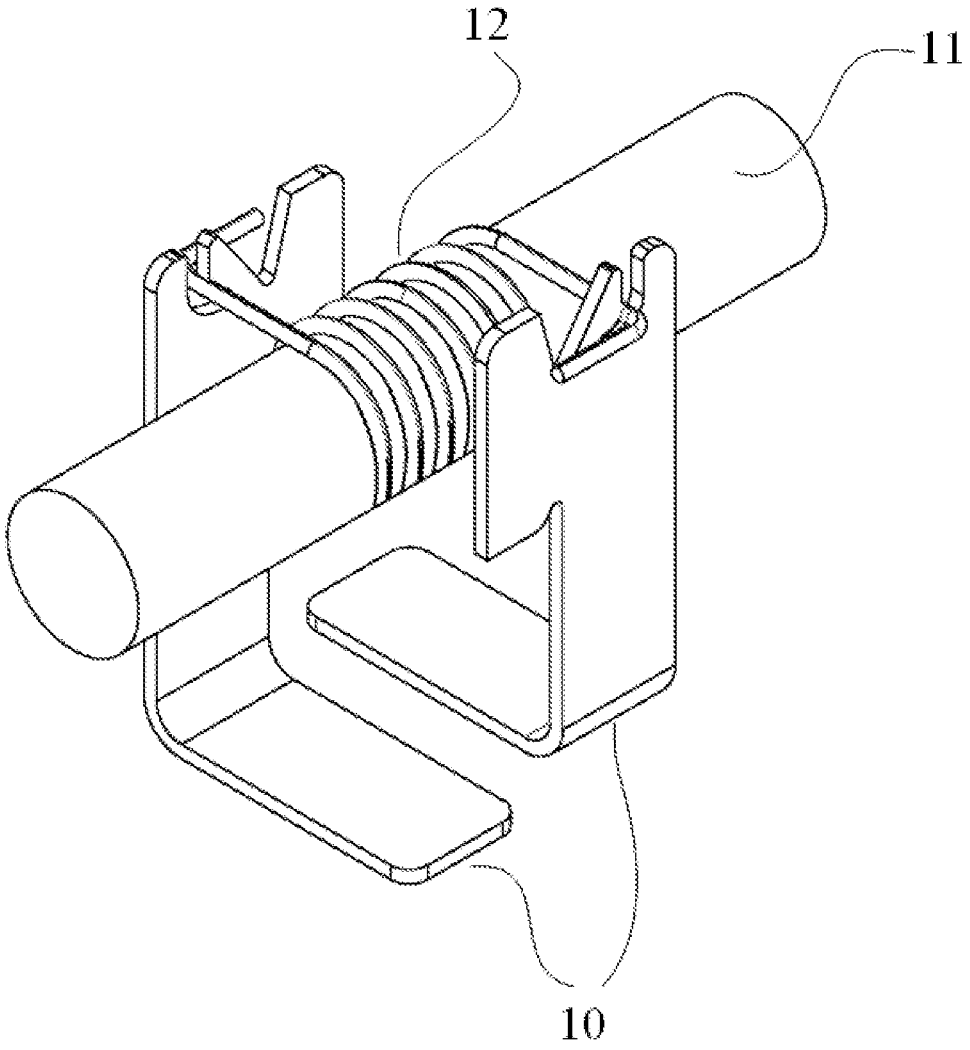
FIG. 10 is an enlarged view of the electrode contact sheets with the heater latched thereon. Names and referrals of the members.

Referring to FIG. 1 through FIG. 6, a preferred embodiment of the invention provides a cigarette cartridge 21. The cigarette cartridge 21 includes a liquid-storage assembly and an atomizing assembly. The atomizing assembly is positioned in the liquid-storage assembly. The liquid-storage assembly includes an upper cover 19 and a housing 18, the upper cover 19 defines a smog outlet 19-2, and the housing 18 defines a liquid-storage chamber 18-5. The atomizing assembly includes a heat generating mechanism 111, an atomizing base 9 and a ventilation pipe 14. The heat generating mechanism 111 is positioned on the atomizing base 9, the atomizing base 9 is hermitically positioned on an end of the housing 18, the upper cover 19 is positioned on an end of the housing 18 opposite to the atomizing base 9. The smog outlet 19-2 is defined on the upper cover 19 opposite to the housing 18. The ventilation pipe 14 fluidly communicates with the heat generating mechanism 111 and the smog outlet 19-2, the ventilation pipe 14, the housing 18, the atomizing base 9 and the upper cover 19 cooperatively forms a liquid-storage chamber 18-5. In the illustrated embodiment, the heat generating mechanism 111 is configured to absorb and heat up the tobacco liquid from the liquid-storage chamber 18-5, allowing the liquid to be atomized, the formed smog is sucked by user via the ventilation pipe 14 and the smog outlet 19-2. The heat generating mechanism 111 can include an absorbing member 11 and a heater 12 matching the absorbing member 11. In the illustrated embodiment, the absorbing member 11 can be selected from one or more than one of the following materials: cotton, fiber glass, cotton cloth, foam metal, porous ceramic, and foamy graphite. The heater 12 can be a heating strip, a heating sheet, a heating film, a heating plate, a heating pipe or a heating block, which is not limited hereby. The atomizing assembly further includes a pair of electrode contact sheets 10, the anode and the cathode of the heater 12 are connected to the pair of electrode contact sheets 10, respectively, thereby allowing the battery assembly 20 to provide power for the heater 12 via the electrode contact sheets 10, when the cigarette cartridge 21 is connected to the battery assembly 20. The electrode contact sheet 10 is fixed on the atomizing base 9. Specifically, in the illustrated embodiment as shown in FIG. 10, an end of the electrode contact sheet 10 defines an electrode latching groove 10-1, the anode and the cathode of the heater 12 are latched into the corresponding electrode latching groove 10-1. The pair of electrode contact sheets 10 is insulated from each other. In addition, referring to FIG. 8 and FIG. 10, by defining a through groove 9-3 on the atomizing base 9, an opposite end of the electrode contact sheet 10 extends through the through groove 9-3, and is bended to allow the electrode contact sheet 10 to be fixed to the atomizing base 9. The lower end of the atomizing base 9 further defines an atomizing base ventilation hole 9-2. When the electronic cigarette is used, outside airflow flows into the electronic cigarette and enters the heat generating mechanism 111 by passing the atomizing base ventilation hole 9-2. The heat generating mechanism 111 heats up the liquid to atomize the liquid, the airflow is mixed with the atomized liquid and flows out from the ventilation pipe 14 and the smog outlet 19-2, and then is inhaled by user.

Figure 6:
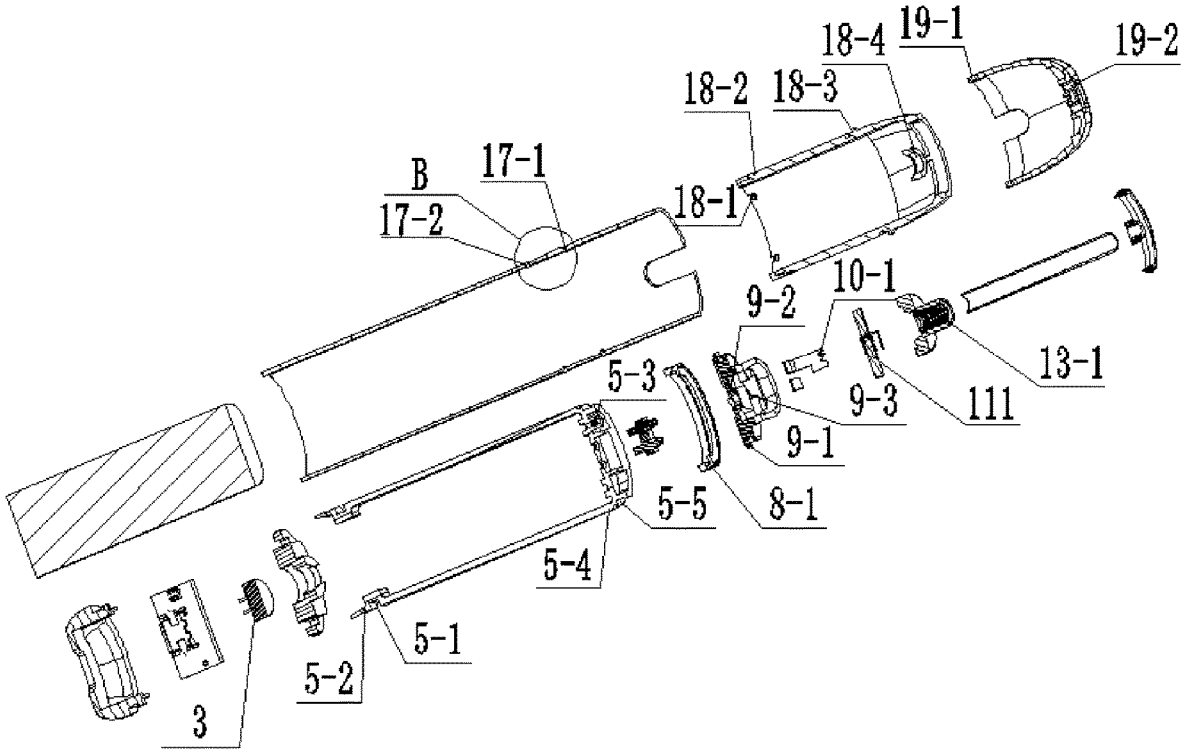
FIG. 6 is a cross-sectional view of the electronic cigarette as shown in FIG. 5.
Figure 7:
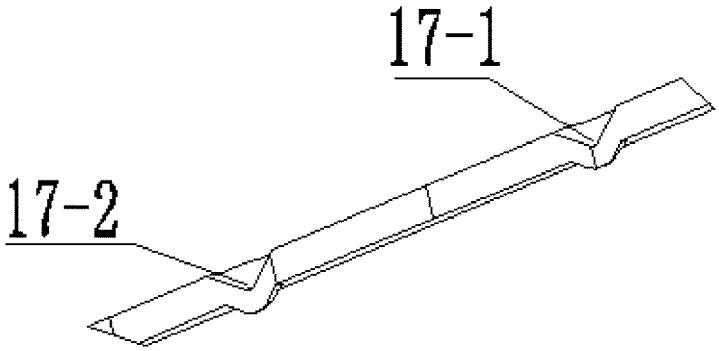
FIG. 7 is an enlarged view of circled portion B of FIG. 6.
Figure 9:
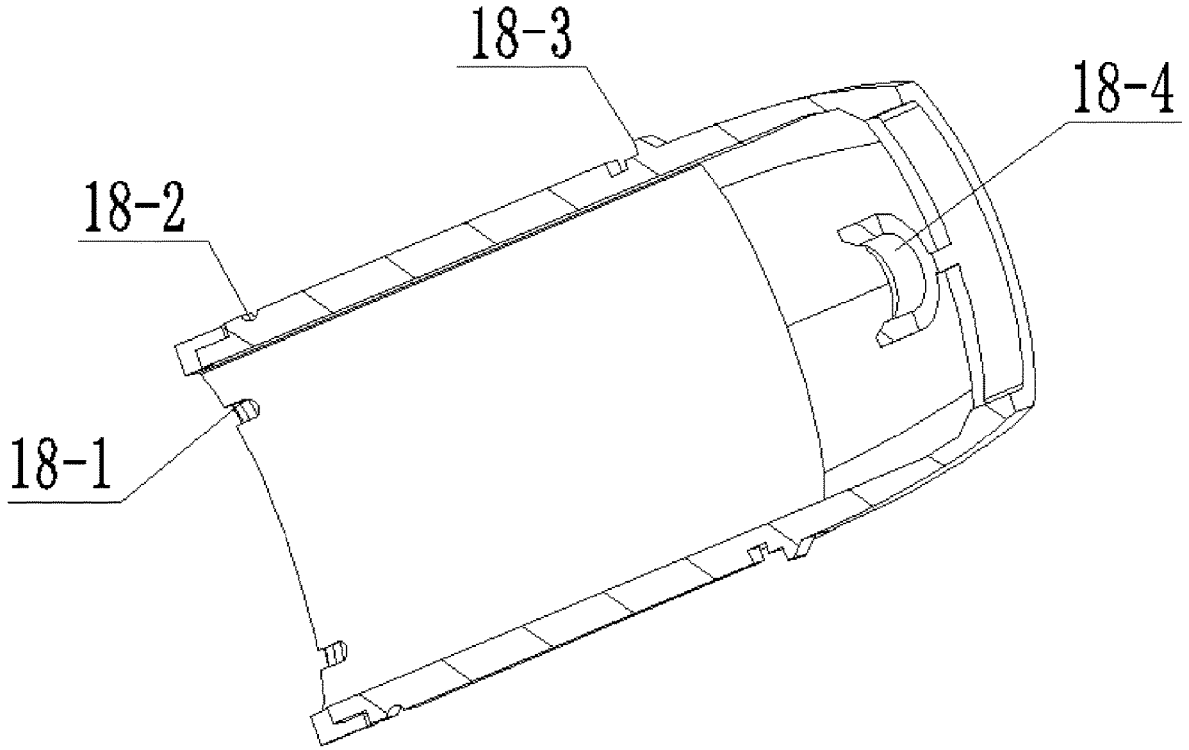
FIG. 9 is a cross-sectional view of a housing of the invention.

Referring to FIG. 6 and FIG. 9, when the housing 18 and the atomizing base 9 are assembled, the housing 18 is provided with a latching groove/a latching tab 18-1 on a periphery of the lower end of the housing 18, the atomizing base 9 is provided with a latching tab/latching groove 9-1 on a corresponding periphery of atomizing base 9, such that the latching tab latches with the latching groove to stably secure the atomizing base 9 to the lower end of the housing 18. The distribution of the latching tabs and the latching groove can vary: for example, the periphery of the lower end of hosing 18 is provided with a plurality of latching grooves, and the corresponding periphery of atomizing base 9 is provided with a plurality of latching tabs. For example, the periphery of the lower end of hosing 18 is provided with a plurality of latching tabs, and the corresponding periphery of atomizing base 9 is provided with a plurality of latching grooves. For example, the periphery of the lower end of hosing 18 is provided with a plurality of latching tabs and a plurality of latching grooves, and the corresponding periphery of atomizing base 9 is provided with a plurality of latching grooves and a plurality of latching tabs.

It can be concluded from aforementioned description, in the cigarette cartridge 21 of the invention, the atomizing assembly and the liquid-storage assembly are separately configured, the heat generating mechanism 111, the atomizing base 9 and the ventilation pipe 14 cooperatively forms the atomizing assembly, the liquid-storage assembly includes the upper cover 19 and the housing 18. The assembled atomizing assembly is then mounted on the housing 18, and then the upper end of the housing 18 is sleeved by the upper cover 19, such that the assembly procedure of the cigarette cartridge 21 is accomplished, the assembly procedure is simplified.

According to a preferred embodiment, the atomizing assembly further includes an atomizing upper cover 13, the heat generating mechanism 111 is fixed between the atomizing upper cover 13 and the atomizing base 9. The atomizing upper cover 13 defines a through hole 13-1, an end of the ventilation pipe 14 extends through the through hole 13-1 and fluidly communicates with the heat generating mechanism 111. A caliber of the through hole 13-1 matches with the outer diameter of the ventilation pipe 14, causing the smog cannot be leaked from the gap between the through hole 13-1 and the ventilation pipe 14. Further, a sealing cover 15 is positioned between aforementioned upper cover 19 and the housing 18, as mentioned above, an end of the ventilation pipe 14 extends through the through hole 13-1 and fluidly communicates with the heat generating mechanism 111, an opposite end of the ventilation pipe 14 extends through the sealing cover 15 and fluidly communicates with the smog outlet 19-2. The function of the sealing cover 15 is that, because the liquid-storage chamber 18-5 stores liquid, the sealing cover 15 can seal the liquid-storage chamber 18-5, thus a leakage of the liquid in transportation or using procedure can be prevented, thus the electronic cigarette is protected at some extent. Further, an inner wall of the housing 18 is provided with a latching portion 18-4, the ventilation pipe 14 is latched and positioned by the latching portion 18-4.

An end of the electrode contact sheet 10 is assembled in the through groove 9-3, the absorbing member 11 extends through the heater 12, and then opposite ends of the heater 12 are latched in the electrode latching groove 10-1. The atomizing upper cover 13 presses the atomizing base 9, the ventilation pipe 14 is fixed to the latching portion 18-4, the housing 18 assembled with the ventilation pipe 14 is fixed to the latching tab/the latching groove 9-1 via the latching groove/the latching tab 18-1. The sealing cover 15 is sleeved on the upper end of the liquid-storage chamber 18-5, the upper cover 19 is fixed to the upper end of the hosing 18 via an upper cover limiting groove 19-1 and an upper cover limiting clip 18-3. The upper cover limiting clip 18-3 is positioned on an outer side of the upper end of the housing 18, such that an assembly procedure of the cigarette cartridge 21 is accomplished.

Referring to FIG. 1 through FIG. 6, the electronic cigarette 100 provided by the invention includes a cigarette cartridge 21 and a battery assembly 20 connected to the cigarette cartridge 21. The cigarette cartridge 21 is any one cigarette cartridge in aforementioned embodiments. The external sidewall of the housing 18 of the cigarette cartridge 21 is provided with a joining portion 18-2, the inner sidewall of a battery housing 17 is provided with a connecting portion 17-1, the connecting portion 17-1 engages the joining portion 18-2, allowing the cigarette cartridge 21 to be fixedly connected to the battery assembly 20 via the joining portion 18-2. Specifically, in the illustrated embodiment, the joining portion 18-2 and the connecting portion 17-1 can be a protrusion and a groove engaging the protrusion. In the illustrated embodiment, the joining portion 18-2 can be a groove, by such configuration, the cigarette cartridge 21 can engage the battery assembly 20 by an inference fit. It can be readily envisioned by one skilled in the art that, the joining portion 18-2 can also be screw, latch or other embodiments having an identical technical effect.

Figure 1:
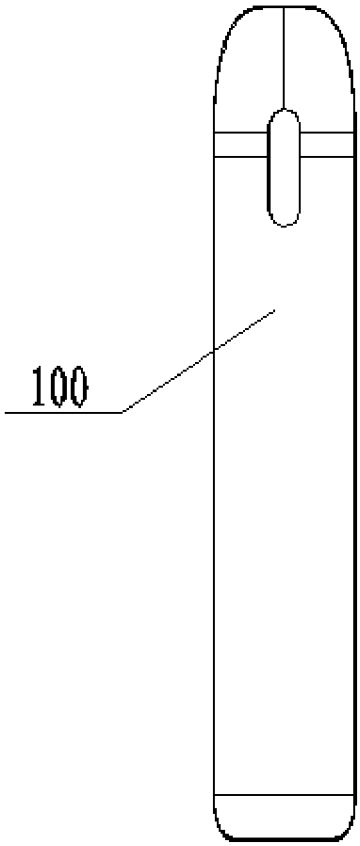
FIG. 1 is an elevation view of an electronic cigarette of the invention.
Figure 2:
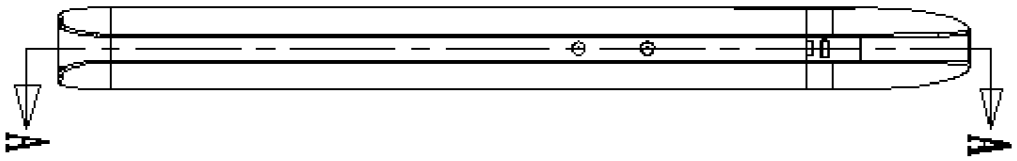
FIG. 2 is a side view of the electronic cigarette as shown in FIG. 1.
Figure 3:
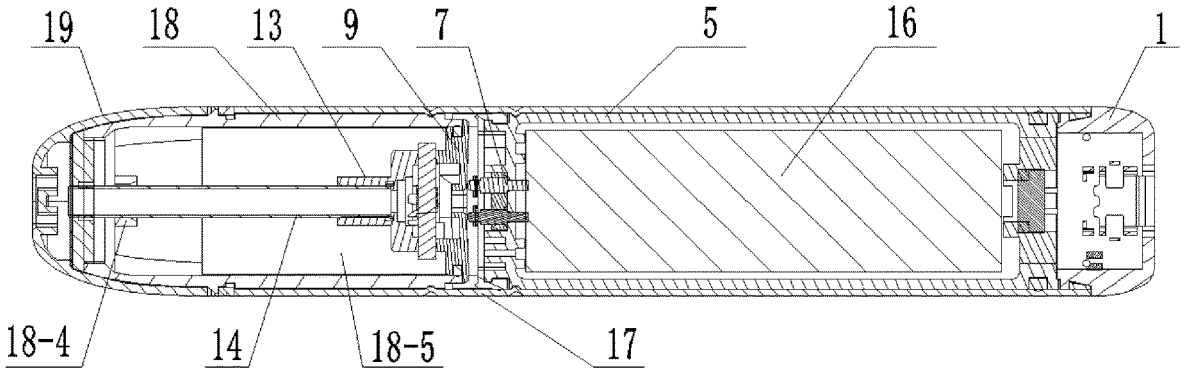
FIG. 3 is a cross-sectional view of the electronic cigarette as shown in FIG. 2, taken along line A-A.
Figure 4:
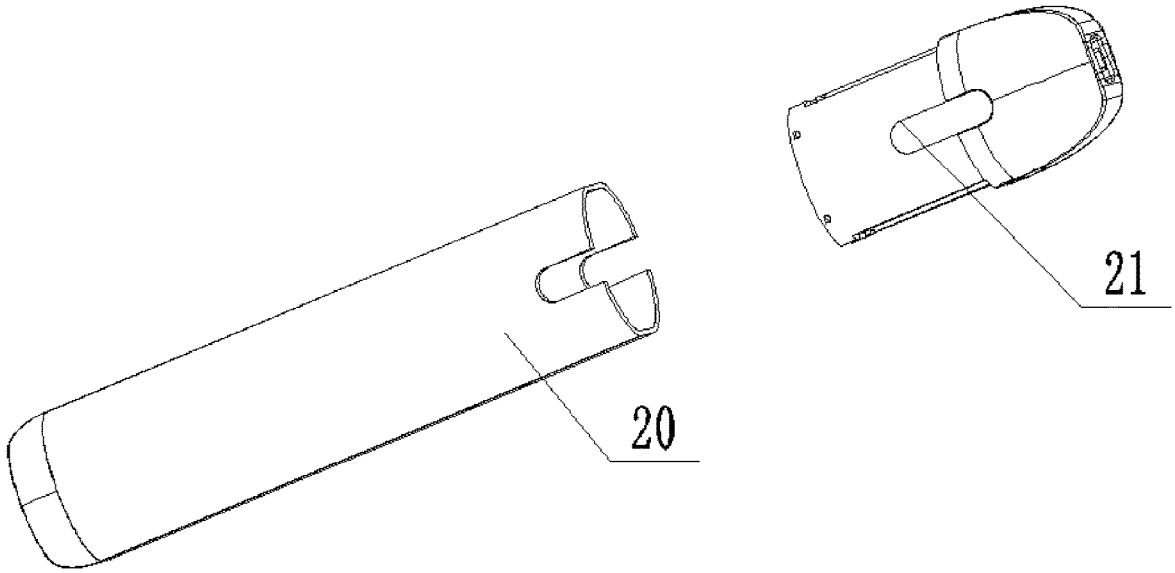
FIG. 4 is an exploded view of a cigarette cartridge and a battery assembly of the electronic cigarette of the invention.
Figure 5:
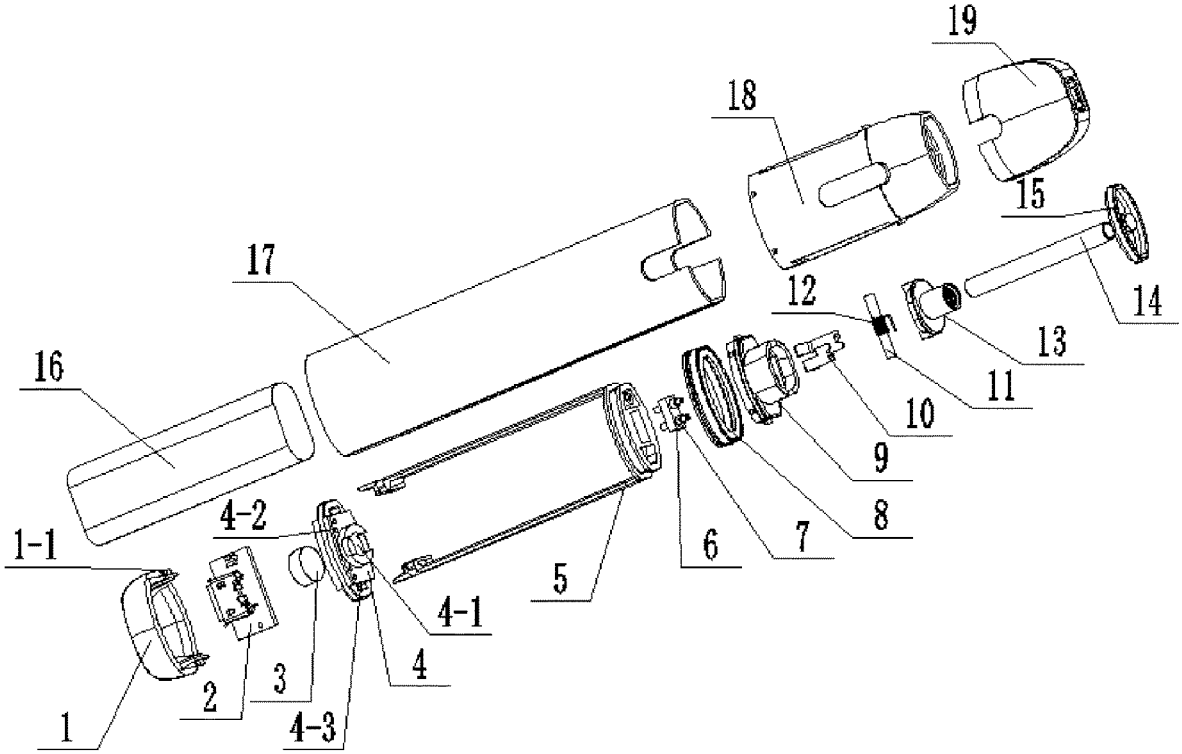
FIG. 5 is an exploded view of the electronic cigarette as shown in FIG. 1.

Referring to FIG. 5 and FIG. 6, the battery assembly 20 further includes a baro-sensor 3, the baro-sensor 3 is configured to sense a pressure variation generated by the an air suction, when the user perform a sucking action to the electronic cigarette 100. The pressure variation signal is fed back to a control panel 2 which is signally connected to the baro-sensor 3. The control panel 2 determines whether the user is sucking or determines a sucking strength according to the pressure variation signal, such that an electric power can be outputted to the cigarette cartridge 21, or the electric power outputted to the cigarette cartridge 21 can be adjusted. Specifically in assembly, the battery assembly 20 further includes a baro-sensor bracket 4, the baro-sensor bracket 4 defines a baro-sensor assembly hole 4-1 and a wire assembly hole 4-2. The baro-sensor 3 is assembled in the baro-sensor assembly hole 4-1, the baro-sensor 3 is electrically connected to the control panel 2 via wires. A wire is led from the control panel 2 and passes through the wire assembly hole 4-2, the wire is connected to a battery base 16. After that, the battery anode/cathode contact member 6 is assembled to the battery bracket 5. The battery anode/cathode contact member 6 is connected to the battery base 16 via wires. The battery anode/cathode contact member 6 further includes two groups of probes 7, the anode wiring terminal and the cathode wiring terminal of the heater 12 are connected to the anode and the cathode of the battery respectively, via the two groups of probes 7. The sealing ring 8 is assembled to a battery bracket sealing ring assembly groove 5-5 via a sealing ring latching groove 8-1. The baro-sensor bracket 4 is fixed to a baro-sensor bracket assembly groove 5-1 of the battery bracket 5 via the assembly groove 4-3. A battery cover 1 is fixed to a battery bracket latching groove 5-2 via a battery cover latching tab 1-1. The battery base 16 is assembled within the battery bracket 5. At the time, the battery housing 17 is sleeved on the battery bracket 5 having the battery base 16, allowing the battery bracket fixing groove 5-4 to be fixed to a battery bracket limiting protrusion 17-2. So far, an assembly of the battery assembly 20 is accomplished. An upper end of the battery bracket 5 further defines a battery bracket ventilation hole 5-3. The battery bracket ventilation hole 5-3 allows a part of the airflow sucked by user to carry out the heat generated by the battery base 16, so as to enable the battery base 16 to remain in a relative normal temperature, which provides a protection function for the battery base 16.

Because the cigarette cartridge 21 is connected to the battery assembly 20 via the joining portion 18-2 and the connecting portion 17-1. When an error of the cigarette cartridge 21 emerges, causing the electronic cigarette 100 cannot working regularly, the battery assembly 20 can be dismantled from the cigarette cartridge 21 via the joining portion and the connecting portion 17-1, a new cigarette cartridge 21 can be replaced conveniently.

Arbitrary combinations made to various embodiments of the invention without prejudice to the spirit of the invention should be interpreted as the contents of the invention. Any modifications, alternatives or improvements made within the principle and spirit of the present application should be interpreted as falling within the protection scope of the present application.

What is claimed is:

1. A cigarette cartridge, comprising:

a liquid-storage assembly comprising an upper cover and a housing;

an atomizing assembly positioned within the liquid-storage assembly and comprising a heat generating mechanism, an atomizing base and a ventilation pipe, wherein the upper cover defines a smog outlet, the heat generating mechanism is disposed on the atomizing base, the atomizing base is hermitically positioned on a first end of the housing, the upper cover is positioned on a second end of the housing opposite to the atomizing base, the ventilation pipe is fluidly connected with the heat generating mechanism and the smog outlet, wherein, when assembled, the ventilation pipe, the housing, the atomizing base, and the upper cover cooperatively form a liquid-storage chamber, wherein the heat generating mechanism comprises an absorbing member, a heater disposed about the absorbing member, an anode of the heater and a cathode of the heater are connected to a first electrode contact sheet and a second electrode contact sheet, respectively, and the first and the second electrode contact sheets are inserted into the atomizing base.

2. The cigarette cartridge according to claim 1, wherein the atomizing assembly further comprises an atomizing upper cover, the heat generating mechanism is disposed between the atomizing upper cover and the atomizing base, the atomizing upper cover defines a through hole, an end of the ventilation pipe extends through the ventilation hole and fluidly communicates with the heat generating mechanism.

3. The cigarette cartridge according to claim 2, wherein a sealing cover is disposed between the upper cover and the housing, an opposite end of the ventilation pipe extends through the sealing cover and fluidly communicates with the smog outlet.

4. The cigarette cartridge according to claim 3, wherein an inner wall of the housing is provided with a latching portion that receives the opposite end of the ventilation pipe.

5. The cigarette cartridge according to claim 1, wherein each of the first electrode contact sheet and the second electrode contact sheet has a first end that a latching groove for receiving the anode or the cathode of the heater, each of the first electrode contact sheet and the second electrode contact sheet has a second end that is bent and configured to insert into a through groove in the atomizing base.

6. The cigarette cartridge according to claim 1, wherein the housing is provided with a latching groove/a latching tab on a periphery of the lower end of the housing, the atomizing base is provided with a latching tab/latching groove on a corresponding periphery of atomizing base, the latching tab latches with the latching groove to attach the atomizing base to the lower end of the housing.

7. An electronic cigarette, comprising a cigarette cartridge and a battery assembly connected to the cigarette cartridge, wherein the cigarette cartridge comprises a liquid-storage assembly comprising an upper cover and a housing;

an atomizing assembly positioned within the liquid-storage assembly and comprising a heat generating mechanism, an atomizing base and a ventilation pipe, wherein the upper cover defines a smog outlet, the heat generating mechanism is disposed on the atomizing base, the atomizing base is hermitically positioned on a first end of the housing, the upper cover is positioned on a second end of the housing opposite to the atomizing base, the ventilation pipe is fluidly connected with the heat generating mechanism and the smog outlet, wherein, when assembled, the ventilation pipe, the housing, the atomizing base, and the upper cover cooperatively form a liquid-storage chamber, wherein the housing of the cigarette cartridge is provided with a joining portion configured to connect the cigarette cartridge with the battery assembly, and wherein the battery assembly comprises a battery, a baro-sensor, and a controller connected to the baro-sensor and the controller.

8. The electronic cigarette according to claim 7, wherein the battery assembly comprises a battery housing, a battery bracket, and a battery base, the battery bracket clamps the battery base and is positioned within the battery housing, an inner sidewall of the battery housing is provided with a connecting portion, the joining portion engages the connecting portion to allow the cigarette cartridge to be fixedly connected to the battery assembly.

9. The electronic cigarette according to claim 8, wherein the battery bracket is provided with a battery anode/cathode contact member, the battery anode/cathode contact member is configured to be connected to an anode and an cathode of the heat generating mechanism, correspondingly, a sealing ring is provided between an upper end of the battery bracket and the battery housing.

10. The electronic cigarette according to claim 7, wherein the baro-sensor is disposed in an air passage and is configured to detect a pressure variation in an air flow in the air passage and sends a signal to the controller, wherein the controller controls a power output of the battery according to the signal received from the baro-sensor.

* * * * *